US005452760A

United States Patent [19]

Bertagnolli

[11] Patent Number: 5,452,760

[45] Date of Patent: Sep. 26, 1995

[54] WELL PUMP TUBING SCRAPERS

[75] Inventor: John T. Bertagnolli, Calgary, Canada

[73] Assignee: Enterra Patco Oilfield Products Limited, Calgary, Canada

[21] Appl. No.: 308,306

[22] Filed: Sep. 19, 1994

[51] Int. Cl.[6] ..... E21B 37/02

[52] U.S. Cl. ..... 166/176; 166/241.2

[58] Field of Search ..... 166/170, 173, 166/176, 241.2, 241.3, 241.4, 241.7

[56] References Cited

U.S. PATENT DOCUMENTS

| | | | |
|---|---|---|---|
| 2,997,106 | 8/1961 | Tripplehorn . | |
| 3,058,524 | 10/1962 | Tripplehorn . | |
| 3,330,359 | 7/1967 | Ward | 166/241.4 X |
| 3,364,998 | 1/1968 | Sable | 166/176 |
| 3,516,494 | 6/1970 | Ward | 166/176 |
| 3,912,007 | 10/1975 | Hellums et al. | 166/176 X |
| 4,787,448 | 11/1988 | Sable | 166/176 |
| 4,995,459 | 2/1991 | Mabry | 166/176 |
| 4,997,039 | 3/1991 | Sable . | |
| 5,339,896 | 8/1994 | Hart et al. | 166/241.1 |

FOREIGN PATENT DOCUMENTS 819448 8/1969 Canada .

*Primary Examiner*—Ramon S. Britts
*Assistant Examiner*—Frank S. Tsay
*Attorney, Agent, or Firm*—Stanley E. Johnson

[57] ABSTRACT

A well pump sucker rod scraper arrangement that includes a sucker rod, scrapers fixed to said rod and a scraper at spaced apart positions movably mounted on said rod, between adjacent pairs of the fixed scrapers. The movable and fixed scrapers each have surfaces at respective opposite ends thereof and an outer fluted surface. The fluted surface is defined by spaced apart ribs and the ribs on the movable scraper are angularly disposed relative to the longitudinal axis of the rod. The movable scraper has a slot lengthwise thereof with a throat portion whose width is narrower than the diameter of the rod and through which the rod passes when pressing such movable scraper onto the rod. A lug on the fixed scrapers project therefrom in a direction toward an adjacent movable scraper and the lugs are so positioned so as to project into said slot of a movable scraper associated therewith as the latter approaches the fixed scraper and prior to engagement of the abutting planar end surfaces on the respective scrapers.

9 Claims, 3 Drawing Sheets

WELL PUMP TUBING SCRAPERS

FIELD OF INVENTION

This invention relates to well tools and more particularly to improvements to scrapers on the sucker rods.

BACKGROUND OF INVENTION

Pumping apparatus is well known to pump liquids, for example oil from a well to the surface through a string of tubing. The apparatus includes a string of sucker rods connected one to the other in end to end relation and the rod is located within the tubing. The bottom end of the lowermost sucker rod is connected to the plunger of any suitable pump. There is a valve arrangement that includes a standing valve and a travelling valve spaced apart from one another that permit the upward flow of liquid through the tubing as the pump plunger is raised and lowered by up and down movement of the string of sucker rods. All this is well known in the art and by way of example reference may be had to the teachings of Canadian patent 819,448 issued Aug. 5, 1969 to Donald E. Sable; U.S. Pat. Nos. 2,997,106 and 3,058,524 issued to Tripplehorn and U.S. Pat. Nos. 4,997,039 and 4,575,163 issued to Donald E. Sable. These patents address different problems in the pumping of oil from a well and disclose the use of fixed and movable scrapers to remove paraffin and other sediments which accumulate on the sucker rods and internal surface of the conduit during pumping of oil from a well. In that the subject is well covered in the foregoing documents there is no need to repeat the same herein and the subject of the foregoing references is incorporated herein by reference thereto.

In a conventional oil well pumping apparatus each sucker rod may have alternately fixed and movable scrapers thereon. A movable scraper is located between two scrapers rigidly or fixedly mounted on the shank at selected spaced apart distances. The spacing of the fixed scrapers may be for example equal to substantially one half of the length of the stroke or distance of travel of the string of sucker rods or more. There may for example be three fixed scrapers and two movable scrapers on a twenty-five foot long sucker rod and the length of travel of the sucker rod string may be only six feet.

Each scraper is generally in the form of a tubular body made of a suitable durable material such as that known by the trade-mark "Nylon" or the like for the movable scraper and a material known by the trade-mark "Ryton" for the fixed scrapers. Each scraper has an internal bore and external diameter correlated to the diameter of the sucker rod and internal diameter of the tubing in which it is employed. Each scraper has a fluted outer surface provided by spaced apart ribs that provide outer scraping edges and fluid passage channels therebetween. The spaced apart ribs, defining the channels therebetween, are at a selected angle to the longitudinal axis of the sucker rod. During pumping the angularly inclined fluid flow channels cause rotational movement of the movable scrapers as a result of relative movement of the liquid and the scrapers. The pitch or angular inclination of the ribs may be chosen as may be desired to provide the desired mechanical strength of the scraper and to permit a relatively low resistance to the flow of well fluids past the scraper and the desired rotation.

The movable scrapers, also sometimes referred to as ambulatory scrapers or migratory scrapers, each reciprocate back and forth between a pair of spaced apart scrapers fixed to the rod. A pair of fixed scrapers provide abutments for the movable scraper confining the same to assigned lengths of the sucker rod. The abutting surfaces normally lie in planes disposed normal to the axis of the sucker rod.

The movable scrapers rotate about the axis of the sucker rod on which they are mounted when there is relative movement between the movable scraper and the fluid. This rotation or spinning of the movable scraper occurs on each of the up and down stroke of the sucker rod. The upper end of the movable scraper will at one time abut against the bottom end of one fixed scraper and at another time the lower end of the movable scraper will abut against the upper end of another fixed scraper spaced from said one fixed scraper. The relative rotation of the fixed and movable scraper causes the abutting surfaces to wear. This wear can be rapid when abrasives are trapped between the abutting surfaces and which abrasives are normally present in the form of particulate sand particles in the oil being pumped. The sand is very abrasive and quickly wears out the abutting surfaces. Rotation of the movable scraper at the same time as wearing the abutting surface on the fixed scraper also causes wear on the sucker rod.

Replacement of the movable scrapers on a sucker rod is relatively simple because the sucker rod is merely forced through a longitudinal gap in the scraper. Replacement of fixed scrapers, however, is not as simple because they are normally molded onto the sucker rod.

It is known to have movable scrapers wherein the internal bore is flared to receive therein the outwardly flared part of an upset end portion of the sucker rod or alternatively a tapered shank portion projecting from a fixed scraper as the case may be. In this arrangement there are planar ends on the fixed and movable scrapers, but the area of such planar ends is reduced and thus wear more quickly. It is conceivable the planar ends could wear sufficiently as to cause the tapered end on the fixed scraper to tightly engage and become wedged in the tapered end recess portion of the movable scraper. This possibility would result in the movable scraper being fixed to the fixed scraper. This would increase the resistance for a reciprocal movement of the sucker rod string and also substantially reduce the intended cleaning action of the movable scraper. Also it is conceivable that extensive wear to the planar abutting surfaces could result in the tapered portion on the sucker rod projecting sufficiently into the movable scraper so as to cause the same to expand increasing the diameter to the extent that it could become wedged in the well tubing.

A principal object of the present invention is to provide means to prevent rotational movement of the movable scraper relative to the sucker rod prior to engagement of the abutment end surfaces of the movable and fixed scraper.

SUMMARY OF THE INVENTION

In keeping with the foregoing there is provided in accordance with the present invention a well pump sucker rod scraper arrangement that includes a sucker rod, a first scraper fixed to said rod and a second scraper slidably and rotatably mounted on said rod, said movable scraper and fixed scraper each having end abutment surfaces at respective opposite ends thereof and an outer fluted surface, said fluted surface being defined by ribs spaced apart from one another providing a liquid flow channel between adjacent pairs of ribs and wherein said ribs on said movable scraper are angularly disposed relative to the longitudinal axis of the rod, said movable scraper having a slot lengthwise thereof with a throat portion whose width is narrower than the diameter of the rod and through which the rod passes when pressing such movable scraper onto the rod and a lug on at least one of said fixed scraper and rod and projecting from the fixed scraper in a direction toward the movable scraper and positioned so as to project into said slot in the movable scraper as it approaches the fixed scraper and prior to engagement of the abutting planar end surfaces on the respective scrapers.

LIST OF DRAWINGS

The invention is illustrated by way of example in the accompanying drawings wherein.

DESCRIPTION OF PREFERRED EMBODIMENT

Figure 1:
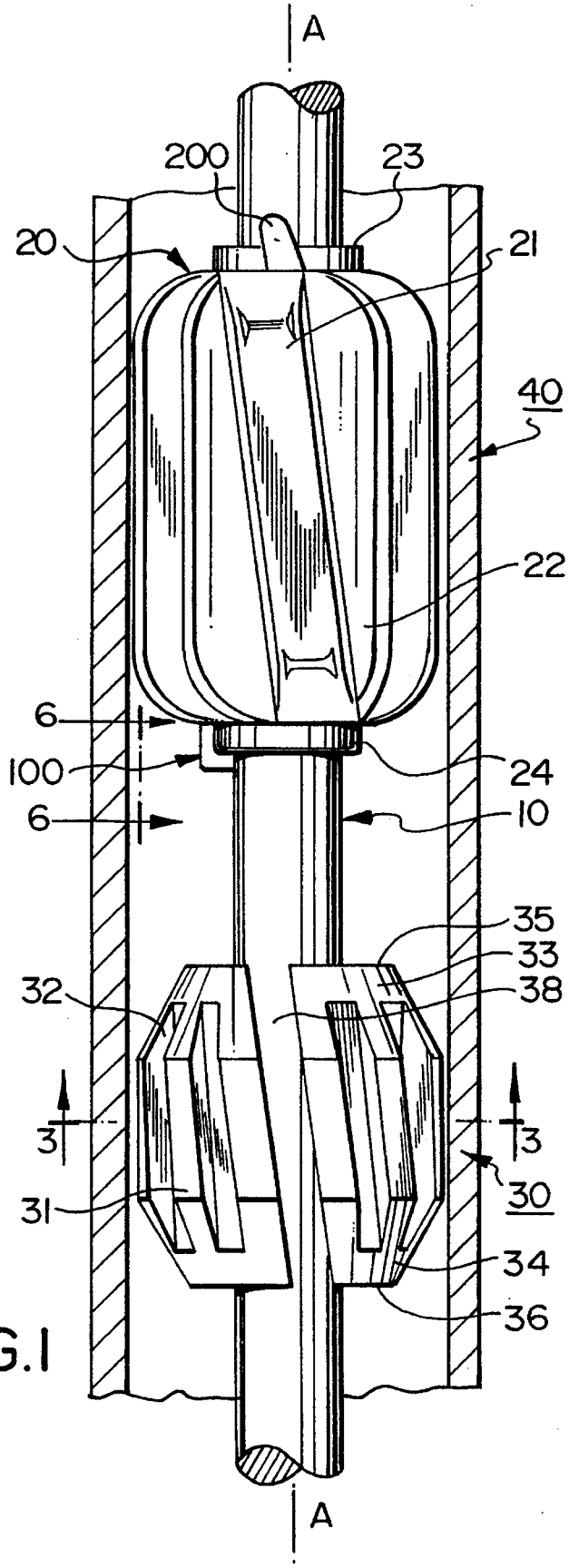
FIG. 1 is a part sectional elevational view of a portion of a sucker rod having each of a fixed and movable scraper thereon and incorporating a lug on the fixed scraper which projects into the slot on the movable scraper preventing rotation of one scraper relative to the other prior to their abutting one another.

Referring to the drawings there is illustrated in FIG. 1 a portion of a sucker rod 10 having a scraper 20 fixed thereto (referred to herein as a "fixed" scraper) and a scraper 30 freely slidably movable along and rotatable on the sucker rod and referred to herein as a "movable" scraper. The sucker rod and scrapers are located in a well tube 40. In accordance with the present invention a lug 100 is provided at the lower end of the fixed scraper so as to prevent the movable scraper therebelow from rotating while the two scrapers are in interengagement with one another. The fixed scraper is also preferably provided at its upper end with a second lug 200 so as to prevent a movable scraper above the fixed scraper from rotating while they are in interengagement with one another. This will be discussed more fully hereinafter.

Figure 2:
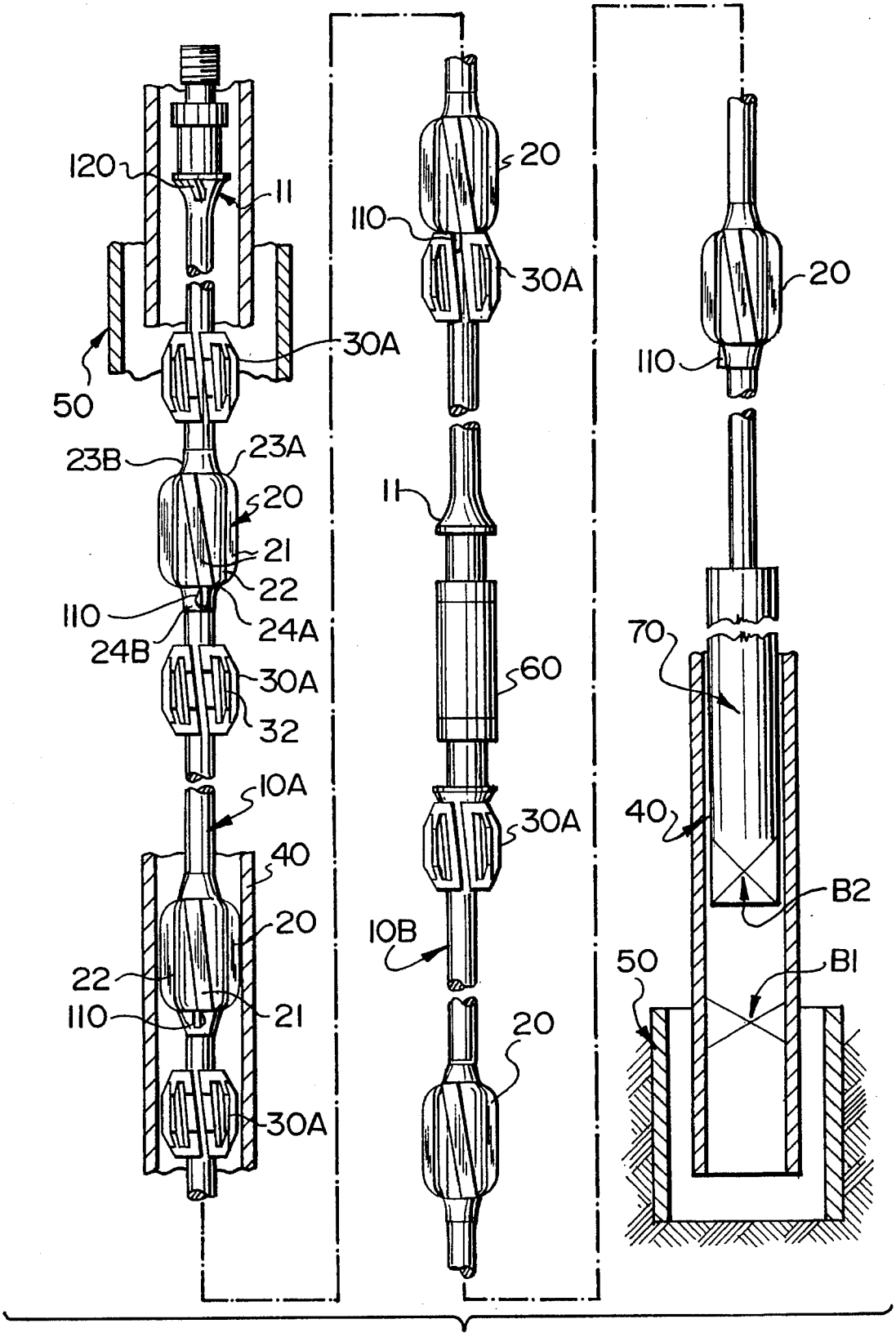
FIG. 2 is a fragmentary partial section view, on a smaller scale, of a sucker rod string in a well tubing incorporating the modification of FIG. 1 and wherein conical projections on the fixed scrapers project into correspondingly shaped end recesses in the movable scrapers.
Figure 3:
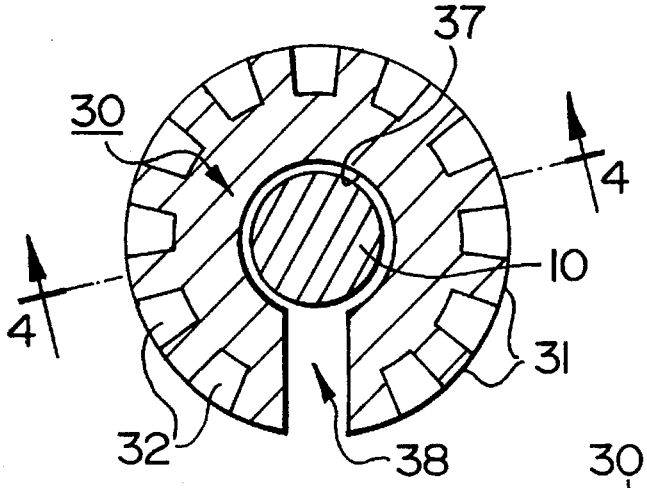
FIG. 3 is a sectional view taken along line 3—3 of FIG. 1.

The below ground portion of a well pumping apparatus is illustrated in FIG. 2 and includes a well casing 50 in which there is located a string of well tubes 40 connected end to end. Within the well tube 40 is a string of sucker rods, two of which are shown and designated 10A and 10B connected end to end by a coupler 60. The lowermost sucker rod is connected to a plunger 70 in a pump barrel that is located in the tubing 40. The upper end of the string of sucker rods is connected to a power driven walking beam located above ground and all of which is well known and therefore not shown. A standing valve and a travelling valve designated respectively B1 and B2 allows the liquid to flow upwardly on an upward stroke of the plunger and remain in its elevated position on the downward stroke of the plunger. The elevated liquid will move somewhat upwardly through the tubing during the downward movement of the string of rods by virtue of being displaced by the sucker rod that moves from the above ground portion of the system into the well tubing.

During a pumping operation the movable scrapers travel between a pair of fixed scrapers 20 on the sucker rods. Each fixed scraper has a fluted outer surface provided by a plurality of ribs 21 spaced apart from one another and the space between adjacent ribs defines a fluid flow channel 22. The ribs 21 may be parallel or inclined to the longitudinal axis A—A of the sucker rod. The fixed scrapers 20 shown in FIG. 1 have respective upper and lower planar surfaces 23 and 24 which provide an abutment to bear against similar flat surfaces on the ends of the movable scrapers to be described hereinafter.

The movable scrapers 30 have a fluted outer surface provided by a plurality of spaced apart ribs 31 and between adjacent pairs of ribs 31 there is a fluid flow channel 32. The ribs, and thus the channels, are inclined relative to the longitudinal axis A—A of the sucker rod. This inclined fluid flow channel causes the movable scraper 30 to rotate about the axis A—A of the sucker rod when there is relative movement between the fluid in the tube 40 and the movable scraper.

The movable scraper is generally a cylindrical body having respective opposite chamfered ends 33 and 34 and flat planar surfaces 35 and 36 at respective opposite ends. The planar surfaces 35 and 36 are perpendicular to the axis A—A of the sucker rod and serve to abut against respective planar surface 24 of one fixed scraper and planar surface 23 of another fixed scraper where such fixed scrapers are spaced apart from one another on the sucker rod. The movable scraper 30 has a cylindrical bore 37 along its longitudinal axis and the diameter of the bore is slightly larger than the diameter of the sucker rod. A slot 38 extends lengthwise of the cylindrical body from the outer surface of the cylindrical body into the bore and such slot has a throat narrower in width than the diameter of the sucker rod. The movable scraper being made of a somewhat resilient material, has sufficient flexibility whereby the movable scraper can be forced onto the sucker rod by pushing the sucker rod through the throat of the slot. The slot 38 is parallel to the ribs and provides a fluid flow channel which is deeper than the remainder of the fluid flow channels.

As previously mentioned, in accordance with the present invention, each fixed scraper 20 has at least a first lug 100 projecting from the lower end thereof and preferably also a second lug 200 projecting from the upper end. Lug 100 projects beyond the planar surface 24 and is so located as to project into an end of the slot 38 of a movable scraper prior to engagement of the planar surface 35 on the movable scraper with the planar surface 24 on the fixed scraper. The lug projecting into the slot provides a positive lock that prevents rotation of the movable scraper relative to the fixed scraper as their respective and adjacent end planar surfaces approach engagement with one another. This relative rotation preventing means minimizes or reduces wear of the planar surfaces. The planar surfaces become purely abutment impact surfaces and thus need not be made to close tolerances. Stopping rotation of the movable scraper while in abutment with a fixed scraper also prevents wear at this location to the sucker rod which otherwise can result in a necking down or reduced diameter of the sucker rod at the fixed scraper. In that the slot 38 extends full length of the cylindrical body liquid is readily displaced from the gap as the lug projects into the same.

The lug 100 may be integrally formed with the body of the fixed scraper or it may be a separate key anchored in the sucker rod and/or fixed scraper.

In the embodiment illustrated in FIG. 1 the lug 100 is molded integral with the fixed scraper. A separate key, however, could be provided as an insert during molding of the fixed scraper in which case the key could be of a material different from that of the fixed scraper. If desired the lug or key could project into a slot in the sucker rod ensuring the fixed scraper would not rotate on the sucker rod.

Figure 6:
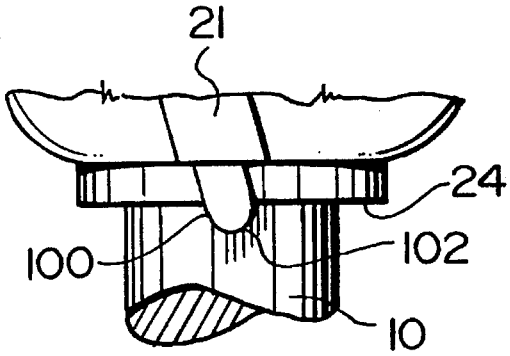
FIG. 6 is a partial left hand side elevational view of FIG. 1 taken along line 6—6.

The lug 100, as seen in FIG. 6, is aligned with one of the ribs 21 and slopes relative to the longitudinal axis of the sucker rod corresponding to the slope of the slot 38 in the movable scraper. The lug 100 is shown with a rounded nose 102 facilitating entry thereof into the end of the slot 38.

The fixed scraper 20 shown in FIG. 1 has a lug 200 at the upper end thereof. This lug prevents rotation of a movable scraper (above the fixed scraper but not shown) relative to the fixed scraper prior to engagement of their respective end abutting surfaces 36 and 23.

In the embodiment illustrated in FIG. 2 there is a movable scraper 30A between pairs of spaced apart fixed scrapers 20 and between an outwardly flared end 11 on the sucker rod and a fixed scraper 20 spaced therefrom. In the FIG. 2 embodiment the fixed scrapers 20 have planar abutting surfaces 23A and 24A at respective opposite ends thereof. Extending from opposite ends of the fixed scraper 20 are respective tapered portions 23B and 24B. These tapered portions decrease in diameter in a direction away from the fixed scraper associated therewith.

Figure 4:
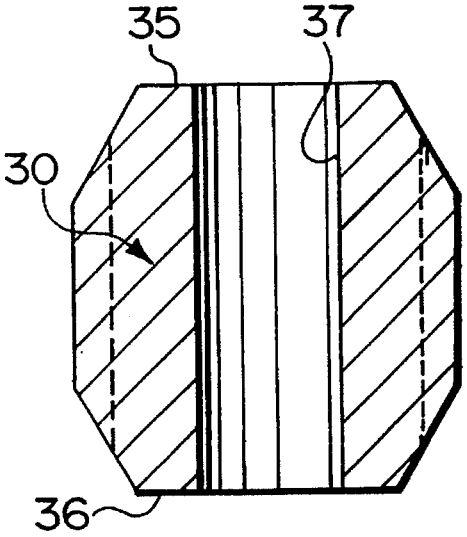
FIG. 4 is a sectional view taken along line 4—4 of FIG. 3.
Figure 5:
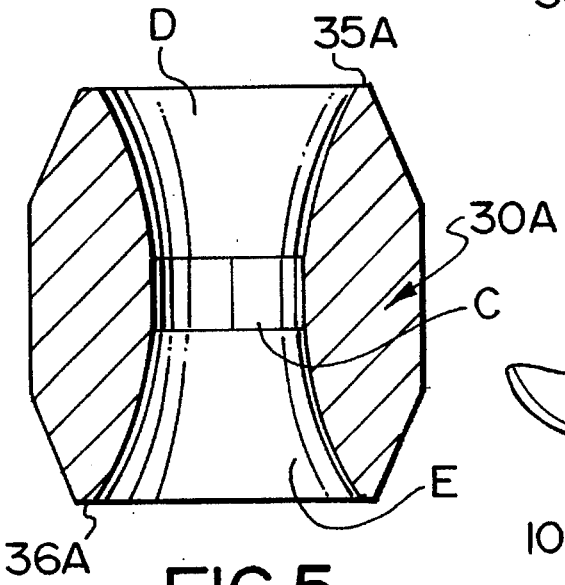
FIG. 5 is a sectional view corresponding to that of FIG. 4, but taken through a movable scraper shown in FIG. 2.

FIG. 5 is a sectional view, similar to FIG. 4, but taken through a movable scraper 30A in the embodiment of FIG. 2. Scrapers 30A have a fluted outer surface and a gap the same as scraper 30 but differ therefrom with respect to the shape of the internal bore through the cylindrical body as is evident from FIG. 5. The bore through the body has a central cylindrical portion C and respective opposite ends D and E that flare outwardly therefrom gradually increasing in diameter in a direction away from the cylindrical portion C. The flared end D receives a tapered section 24B on one fixed scraper and the outwardly flared opposite end E receives therein an outwardly flared end 23B of another fixed scraper 20.

The movable scraper 30A has a flat planar surface 35A at one end thereof and a flat planar surface 36A at the opposite end. These planar surfaces are perpendicular to the longitudinal axis of the sucker rod. The flat planar surface end 35A engages the flat planar surface 24A on fixed scraper 20 prior to the outwardly flared section D engaging the tapered end 24B on the fixed scraper. Similarly the opposite end planar surface 36A, when the movable scraper is in is lowermost position engages the flat planar surface 23A of the fixed scraper 20 prior to the outwardly flared section E engaging the tapered end 23B of scraper 20. The engagement of the surfaces is with respect to the extreme limits of the movable scraper between two spaced apart adjacent fixed scrapers on the sucker rod. In this embodiment the tapered end 24B of the fixed scraper has an enlargement 110 thereon in the form of a rib extending radially outwardly with respect to the longitudinal axis of the sucker rod. The rib 110 is inclined relative to the longitudinal axis of the sucker rod with the inclination corresponding that of the gap 38 in the movable scraper. The opposite end of the fixed scrapers has an enlargement 210 thereon that projects into the gap 38 of a movable scraper preventing rotation as it approaches and prior to engagement with the fixed scraper.

In the FIG. 2 embodiment there is a movable scraper between the outwardly flared upper end 11 on the sucker rod and the first fixed scraper on the sucker rod spaced from the enlarged end. The enlargement 11 at the upper end of the sucker rod can be provided with a rib such as a weld-on enlargement 120 that projects into the end of the gap 38 of the movable scraper when the movable scraper approaches that end of the rod.

We claim:

1. A well pump sucker rod scraper arrangement that includes a sucker rod, a first scraper fixed to said rod and a second scraper slidably and rotatably mounted on said rod, said movable scraper and fixed scraper each having end abutment surfaces at respective opposite ends thereof and an outer fluted surface, said fluted surface being defined by spaced apart ribs providing a liquid flow channel between adjacent pairs of ribs and wherein said ribs on said movable scraper are angularly disposed relative to the longitudinal axis of the rod, said movable scraper having a slot lengthwise thereof with a throat portion whose width is narrower than the diameter of the rod and through which the rod passes when pressing such movable scraper onto the rod and a lug at said fixed scraper adjacent said rod, said lug being fixed relative to said fixed scraper and projecting from said fixed scraper in a direction toward the movable scraper and positioned so as to project into said slot in the movable scraper as the said movable scraper approaches the fixed scraper and prior to engagement of the abutment end surfaces on the respective scrapers.

2. The arrangement as defined in claim 1 wherein said lug is integrally formed with said fixed scraper.

3. The arrangement as defined in claim 1 including an insert molded into said fixed scraper and wherein said insert projects from said fixed scraper providing said lug.

4. The arrangement as defined in claim 1 wherein said slot and lug are each inclined corresponding to the inclination of said ribs on said movable scraper.

5. The arrangement as defined in claim 1 wherein said lug projects downwardly from the lower end of each scraper fixed to the sucker rod.

6. The arrangement as defined in claim 1 wherein said lug projects upwardly from the upper end of each scraper fixed to the sucker rod.

7. The arrangement as defined in claim 1 including a pair of lugs projecting from each fixed scraper, one of said pair of lugs on each fixed scraper projecting upwardly providing a rotation preventing means for a movable scraper above the fixed scraper associated therewith and the other of said pair of lugs projecting downwardly providing a rotation preventing means for a rotary scraper below fixed scraper associated therewith.

8. The arrangement as defined in claim 1 wherein said fixed scraper has a tapered end section projecting therefrom along the sucker rod, said tapered end section decreasing in diameter in a direction away from said fixed scraper toward an adjacent movable scraper on said rod, wherein said movable scraper has a tapered recess in an end portion thereof to receive therein said tapered end section and wherein said lug is located on said tapered end section.

9. The arrangement as defined in claim 8 wherein said lug comprises a rib integrally formed with said tapered end section and projecting outwardly therefrom in a direction away from said rod.

* * * * *